US006378607B1

(12) United States Patent
Ryan et al.

(10) Patent No.: US 6,378,607 B1
(45) Date of Patent: Apr. 30, 2002

(54) METHOD AND SYSTEM FOR ORIENTED PERFORATING IN A WELL WITH PERMANENT SENSORS

(75) Inventors: Sarah Elizabeth Ryan, Cambridge (GB); Ian Raw, Sugar Land, TX (US)

(73) Assignee: Schlumberger Technology Corporation, Ridgefield, CT (US)

( * ) Notice: Subject to any disclaimer, the term of this patent is extended or adjusted under 35 U.S.C. 154(b) by 0 days.

(21) Appl. No.: 09/328,728

(22) Filed: Jun. 9, 1999

(51) Int. Cl.[7] ..... E21B 29/00; E21B 43/119; E21B 47/09

(52) U.S. Cl. ..... 166/255.2; 166/255.1; 166/297; 166/55; 175/4.51

(58) Field of Search ..... 166/55, 255.2, 166/255.1, 254.1; 175/4.51

(56) References Cited

U.S. PATENT DOCUMENTS

| | | | | |
|---|---|---|---|---|
| 3,104,709 A | | 9/1963 | Kenneday et al. | 166/55.1 |
| 3,149,671 A | | 9/1964 | Alexander, Jr. | 166/21 |
| 3,180,409 A | | 4/1965 | Dewan | 166/4 |
| 3,342,275 A | | 9/1967 | Mellies | 175/4.51 |
| 4,475,591 A | | 10/1984 | Cooke, Jr. | |
| 5,947,199 A | * | 9/1999 | Havig | 166/250.01 |
| 5,996,689 A | * | 12/1999 | Head | 166/77.2 |
| 6,131,658 A | * | 10/2000 | Minear | 166/250.01 |

OTHER PUBLICATIONS

Schlumberger Reservoir Completions Technology Center Perforator Orientation Tool (POT–CA) Data Sheet, Feb. 1996.

Finnegan, P. Gun Orienting in Multiple String Completions The Perforating and Testing Review, Feb. 1993, vol. 6, No. 1.

* cited by examiner

*Primary Examiner*—David Bagnell
*Assistant Examiner*—Jennifer H. Gay
(74) *Attorney, Agent, or Firm*—William B. Batzer; William L. Wang

(57) ABSTRACT

A method and system is provided for perforating a casing in a hydrocarbon well so as to avoid perforating in a direction where a cable resides. A mass of metallic material is clamped to the casing at a predetermined offset angle with respect to the cable. The angular position of the metallic mass is detected using a detector placed inside the casing. Then, a perforating gun is oriented based on the detected angular position of the metallic mass and the predetermined offset angle. Finally, the casing is perforated so as to avoid damage to the cable. The cable comprises a number of electrical conductors and is used to communicate with permanent sensors located on the cable in the vicinity of the casing to be perforated.

25 Claims, 7 Drawing Sheets

VIEW I-I′

METHOD AND SYSTEM FOR ORIENTED PERFORATING IN A WELL WITH PERMANENT SENSORS

FIELD OF THE INVENTION:

The present invention relates to the field of perforating casings of hydrocarbon wells. In particular, the invention relates to a method and system for oriented perforating of a well casing in the vicinity of a cable such as could be used for permanent sensors.

BACKGROUND OF THE INVENTION:

As part of the completion process for hydrocarbon wells, a steel casing is placed inside the borehole and subsequently cemented in place. The casing, the cement, and portions of the subterranean formation are then perforated using conventional perforation techniques. Ordinarily, the perforations are made in various directions generally perpendicular to the axis of the borehole in the vicinity of the hydrocarbon reservoir using a perforating gun. In some situations, however, the perforations may need to be made so as to avoid a certain direction. For example, if a cable of some kind is located in the borehole but outside the casing during the perforation process, the perforations may need to be directed away from the cable to avoid damage to it. Such a cable could be cemented in place and used for telemetry, or be part of a permanently placed sensor arrangement. If the perforations are made in the direction of such a cable, the cable could be perforated, damaged, or destroyed.

In a deviated hole the perforating guns may be oriented by use of swivels and rollers. However, this technique may not be suitable for avoiding cables and the like since the exact direction of the cable may not be known due to unintended twisting or turning of the cable and casing. Furthermore, the use of swivels and rollers this is not suitable in vertical wells as gravity is not available to assist in the orientation.

Directly sensing the location of the cable has difficulties as well. For example, a cable cemented in place outside the casing is not easily detected with instruments placed inside the casing during perforation, since the detectable signal from the cable is normally either non-existent, or too weak to be a reliable indicator of the cable location. Therefore an alternative method of orientating the perforating gun is needed.

SUMMARY OF THE INVENTION:

Thus, it is an object of the present invention to provide an apparatus and method for orienting a perforation gun in a borehole so as to avoid perforating a cable or sensors located in the area to be perforated.

According to the invention, a method is provided for perforating a conduit in a hydrocarbon well so as to avoid perforating in a direction where a cable resides. A mass of preferably metallic material is fixed to the conduit at a predetermined offset angle with respect to the cable. The angular position of the mass of material is detected using a detector adapted to sense the mass of material. A perforation device is oriented based on the angular position of the mass of material and the predetermined offset angle, such that the perforation device will create perforations in the conduit in a direction substantially away from the cable. Finally, the conduit is perforated so as to avoid substantial damage to the cable.

According to a preferred embodiment, the method is used to perforate casings used in hydrocarbon wells. The detector is located inside the casing, and the mass of metallic material (preferably a form of steel) is located outside the casing. Additionally, the cable comprises a number of electrical conductors and is used to communicate with a number of permanent sensors located on the cable in the vicinity of the casing to be perforated. The cable and metallic mass are clamped to the exterior surface of the casing using specially adapted clamps. The predetermined offset angle is preferably approximately 180 degrees.

Figure 1:
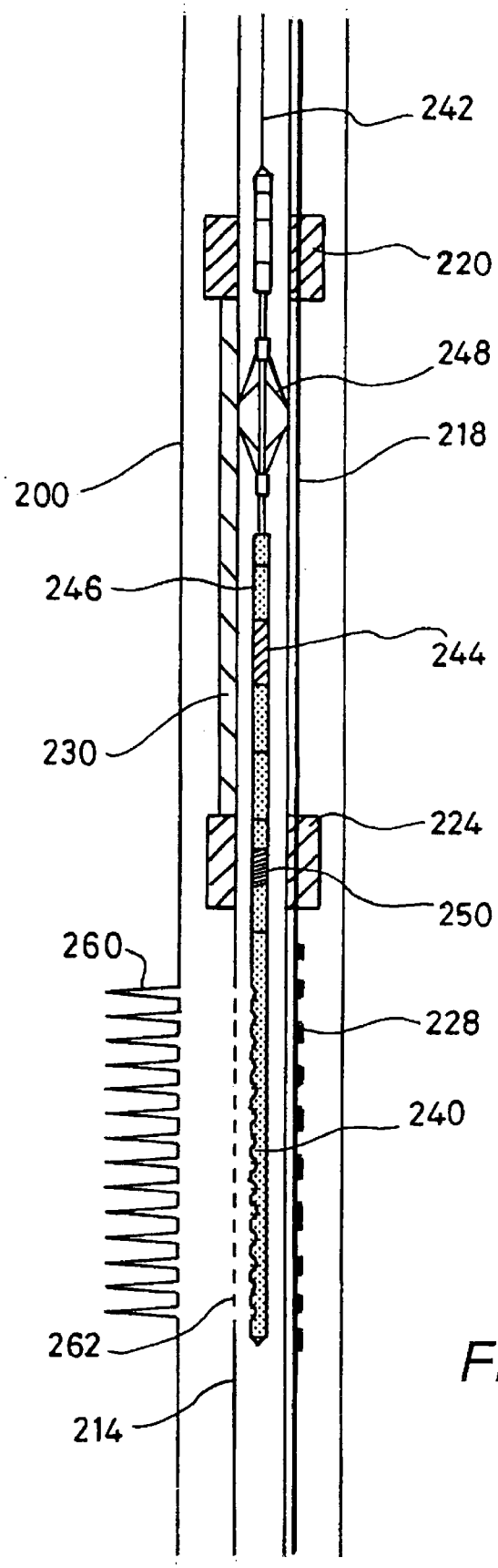
FIG. 1 shows a cross-sectional view of an apparatus for oriented perforation according to a preferred embodiment of the invention.

DETAILED DESCRIPTION OF THE INVENTION:

The following embodiments of the present invention will be described in the context of oriented perforation of a casing in the vicinity of a permanent sensor cable, although those skilled in the art will recognize that the disclosed methods and structures are readily adaptable for broader application. For example, the invention is readily adaptable to oriented perforating of casing to avoid damage to other structures besides cables. Note that whenever the same reference numeral is repeated with respect to different figures, it refers to the corresponding structure in each such figure.

FIG. 1 shows a cross-sectional view of an apparatus for oriented perforation according to a preferred embodiment of the invention. Borehole 200 is shown in the vicinity of a hydrocarbon reservoir. Casing 214 is inserted in borehole 200. Although 214 is shown as a casing, the invention is also applicable to tubings within casings as well as other conduits. Along the right side of casing 214 is a cable 218. In general, cable 218 can be used for many different purposes such as telemetry, power, or depth control. However, according to a preferred embodiment, the cable contains a plurality of electrical conductors and is used as part of a permanent sensor arrangement. The cable may also include a plurality of fiber optic lines. As shown in FIG. 1, an array of permanently installed resistivity sensors 228 forms an integral part of cable 218. Cable 218 and sensors 228 are fixed to the exterior of casing 214 using a number of clamps such as clamp 224. According to the preferred embodiment, the clamps used to fix the cable to the casing are placed over the casing collars, which in this case are spaced apart by about 30 feet, which is the approximate length of one joint of casing.

A bar of material 230 is fixed to the exterior of the casing as shown in FIG. 1. Bar 230 is preferably made of a durable and inexpensive material such as steel, but it could also be made of another material which is suitable for detection by instruments when position in the borehole. According to the preferred embodiment, bar 230 is clamped at a fixed location with respect to cable 218. Although clamps are used to secure bar 230 in the preferred embodiment disclosed herein, the use of other fixing means can be used. For example, welding, gluing or brazing the bar in place could be used. Additionally, the bar could form an integral part of the conduit. For example, a pecial casing could be machined having a metal mass on one side such that an instrument could sense orientation down hole.

In FIG. 1, bar 230 is positioned approximately 180 degrees from cable 218. Thus, in the example shown in FIG. 1, an offset angle of 180 degrees between bar 230 and cable 218 is obtained by using clamp 224 to fix both bar 230 and cable 218 to casing 214. Clamp 220 is also shown to hold both bar 230 and cable 218, however in some embodiments the upper clamp 220 is only used to hold the bar and is not used to hold the cable.

Although an offset angle of 180 degrees is preferred, the angle of offset between the metal mass and the cable may be any predetermined amount. As used herein, the phrase "offset angle" or "angle of offset" are the angles measured between a line from the axis of the conduit to the mass of material and a line from the axis of the conduit to the cable. So long as the offset angle between the metal mass and the cable is known, the angular position of the cable can be determined by detecting the position of the bar. For example, the bar could be located at the same angular position as the cable. In this case, the cable could be clamped inside the mass at installation. Alternatively, the cable and the mass could be combined or integrated. According to this embodiment a special portion of cable would have an extra mass of material included over the desired length. If a more sensitive or different type of sensor tool is used to sense the position of the bar, a smaller amount of material could be used. For example, if a gamma-ray detector is used, a relatively small amount of radioactive material could be integrated into the cable itself.

According to a preferred embodiment, bar 230 is clamped in a position a short distance above (or nearer to the surface rig in lateral borehole sections than) the area to be perforated. This relative placement is preferred since the sensing device will normally be located just above the perforating gun. In general, bar 230 should be placed in a vertical position which best suits the sensor location and sensor technique used. It is preferred that the distance from the bar to the perforation area be kept relatively short, since this lessens the chance that the cable has twisted to a different angular position in the perforation area.

According to an another embodiment, the present invention could be used to avoid perforating sensors that are attached to a casing without a cable present at the time of perforation. Referring to FIG. 1, sensors 228 are be attached to the outside of the casing as shown in FIG. 1, and communicate with the surface via a cable that is inserted inside the casing after the perforation process. In this case, cable 218 is not present, and clamps 224 and 220 hold bar 230 in a known offset angle (here about 180 degrees) from sensors 228.

During the completion process of the hydrocarbon well, the region between casing 214 and the wall of borehole 200 is cemented. Thus, following cementing, casing 214, cable 218, sensors 228, bar 230, and clamps 224 and 220 are encased in cement.

Following the cementing, according to conventional practice, a perforating gun would be lowered inside the casing to the desired depth and fired to create suitable perforations. However, when a cable or the like is in the vicinity where the perforations are to be made, some method of properly orienting the perforating gun is required.

According to a preferred embodiment, bar 230, which can be detected by a suitable instrument, is placed at a known offset angle to the cable. The preferred tool for orienting the perforating gun is used by Schlumberger and is known as the Perforator Orientation Tool or "POT-CA" tool. The POT-CA tool is designed to allow oriented perforating in multiple string completions, where there is more than one tubing or casing in the same borehole. In perforating a casing in a multiple string completion, there is a need to avoid perforating the other casing. The POT-CA tool is more fully described in a data sheet entitled "Perforator Orientation Tool (POT-CA)" published by Schlumberger, dated Feb. 7, 1996, and in an article entitled "Gun Orienting in Multiple String Completions" by Pat Finnegan, The Perforating and Testing Review, Vol. 6, No. 1, both of which are incorporated herein by reference.

The POT-CA tool takes an electromagnetic measurement that will, in many situations permit the operator to establish the orientation of the perforating gun. The perforating gun is rotated downhole and stopped at the desired orientation.

Used conventionally, however, tools such as the POT-CA tool cannot be used to orient a perforating gun so as to avoid damage to a cable or the like located outside the casing. This is because the signal from the cable that is detectable from inside the casing is either nonexistent, or is too weak to be used reliably to orient the perforating gun.

According to the invention, referring to FIG. 1, the POT-CA tool comprises a motor section 246 that contains a DC motor, a drive shaft coupler with an 8 lobe cam and a micro switch for detecting tool rotation. The motor runs on positive 60 volts DC and approximately 100 mA current. The motor rotates approximately one revolution per minute and is capable of producing almost 200 inch-pounds of torque; enough torque to rotate a twenty foot perforating gun. A robust design ensures that the tool will withstand the detonation of the perforating gun.

The POT-CA tool and perforating gun 240 are suspended in the casing by cable 242. Above the motor section 246, a collar assembly and centralizer core 248 is provided to resist the torque and prevent twisting of cable 242 while rotating the gun 240 downhole. Rollers are provided to grip the inside of the casing 214 so as to preventing the twisting.

Detector section 244 contains three different coils. The Exciter coil establishes a magnetic field around the casing. This magnetic field is then distorted by the metal mass around it. The distorted magnetic field is then received by a reference coil, and detector coil, which calculate the magnetic flux. The direction of highest flux corresponds to the increase in metal mass, i.e. the position of the other tubing string or the metal bar. Below detector 244 is shock absorber 250, which is used to protect the POT-CA electronics from damage caused by the shock of the detonating perforating guns. The shock absorber 250 transmits torque from the POT-CA to the perforating gun 240.

As the POT-CA tool and gun rotate downhole, the electromagnetic metal detector produces a metal proximity profile and the position of the metal mass is determined. Upon command, the POT-CA tool rotates and stops. When the perforating gun 240 is in the desired position, i.e. the shots are pointing in a direction away from cable 218, the operator detonates perforating gun 240. Perforating gun 240 forms perforations in the casing 262, the cement, and part of the formation 260.

As the POT-CA tool senses the position of a metal mass, bar 230 is made of a metallic material such as steel. However, if other types of sensors are used, other types of material masses should be used that complement the sensing technique being used. For example, if a gamma-ray sensor is used, the material mass may include a small amount of radioactive material, commonly referred to as a pip-tag. In this embodiment, the mass of material could advantageously be kept to small dimensions, and could thus more easily integrated into the cable, clamp, or the casing itself.

Figure 2:
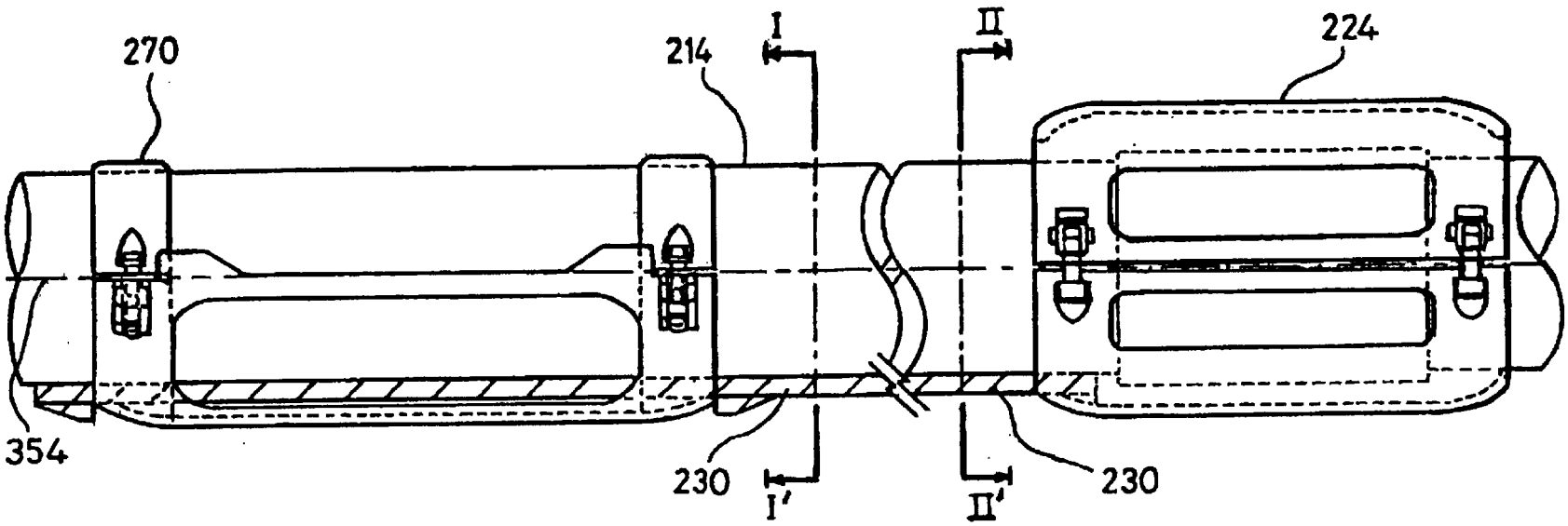
FIG. 2 shows clamps used to hold the cable and bar in place, according to a preferred embodiment of the invention.

FIG. 2 shows the clamps used to hold the cable and bar in place, according to a preferred embodiment of the invention. As shown, bar 230 is fixed to casing 214 by clamps 224 and 270. Casing 214 is shown with a central axis 354 and an exterior surface. According to this embodiment, clamp 224 is used to hold both the cable and bar 230, a clamp 270 is used to hold only bar 230. According to a preferred embodiment, clamp 270 is above clamp 224 (or nearer to the surface rig in the case of horizontal sections), and the area to be perforated is below clamp 224 (to the right of clamp 224 in FIG. 2). By clamping the bar and the cable near to the perforation area, the risk that the cable has twisted out of location in the perforation area is lessened. However, the clamps could be positioned differently. For example clamp 270 could be positioned below clamp 224.

The dimensions of bar 230 should be such that the sensing tool can detect the bar and accurately determine its position when placed down hole. According to the preferred embodiment bar 230 is approximately 8 feet long, 2 inches wide and 0.5 inches thick. Thus, the distance between the clamps shown in FIG. 2 is about 8 feet. If a more sensitive or different type of sensing tool is used, it is preferable that a smaller mass also be used.

Figure 3:
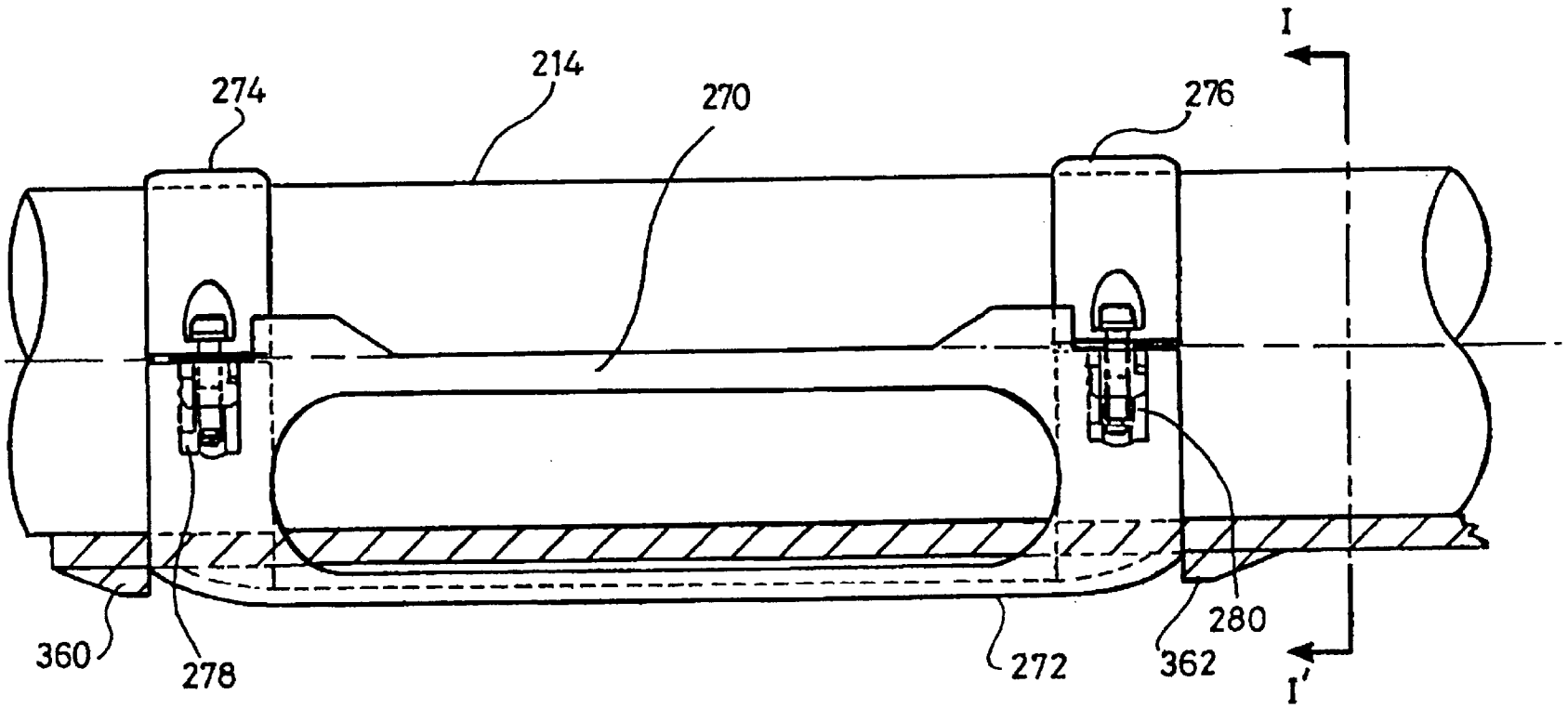
FIG. 3 shows a more detailed view of a clamp used to hold the cable and bar in place, according to a preferred embodiment of the invention.

FIG. 3 shows a more detailed view of clamp 270, according to a preferred embodiment of the invention. Clamp 270 comprises body 272, two hinged collars 274 and 276, hinge pins (not shown) and screws and toggles 278 and 280. Flanges 360 and 362 are preferably provided on bar 230 to prevent relative movement between bar 230 and clamp 270.

Figure 4:
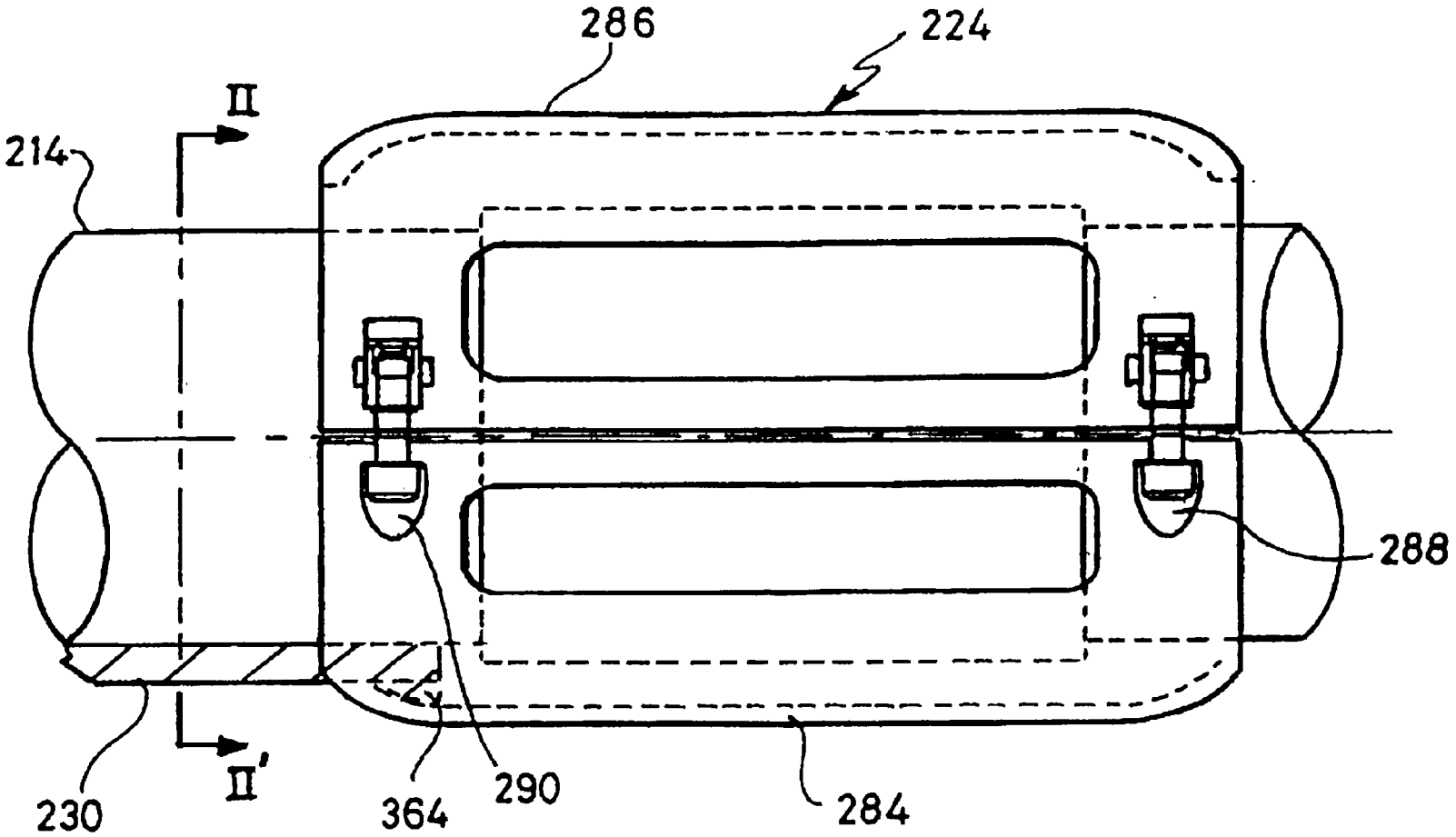
FIG. 4 shows a more detailed view of a clamp used to hold the bar in place, according to a preferred embodiment of the invention.

FIG. 4 shows a more detailed view of clamp 224, according to a preferred embodiment of the invention. Clamp 224 comprises lower body 284, upper body 284, hinge pins (not shown) and screws and toggles 288 and 290. As shown, bar 230 terminates in the lower body 284. Additionally, flange 364 is preferably provided to prevent relative movement between bar 230 and clamp 224. Note that lower body 284 and upper body 286 are dimensioned so as to fit over a casing collar, or threaded link between the sections of casing, and is of slightly larger diameter then the rest of the casing.

Figure 5:
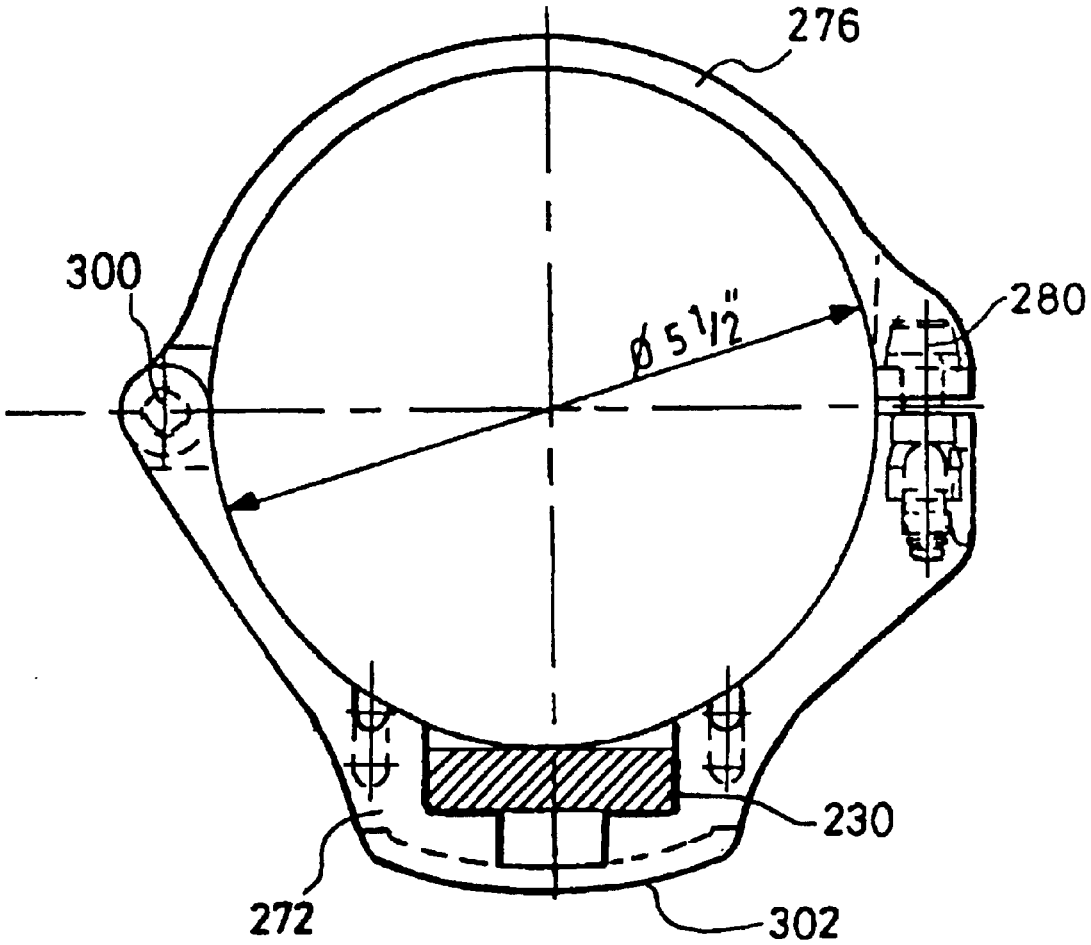
FIG. 5 shows a view of clamp depicted in FIG. 3 in the direction of A–A', according to a preferred embodiment of the invention.

FIG. 5 shows a view of clamp 270 in the direction of A–A', according to a preferred embodiment of the invention. The portions of clamp 270 shown in FIG. 5 include body 272, collar 276, screw and toggle 280, and hinge pin 300. Note that bar 230 is held in position by the notch in body 272. Preferably portion 302 of body 272 is rounded to approximately match the diameter of the borehole and serves to space and protect bar 230 from the wall of the borehole. In the example shown in FIGS. 5–7, the casing diameter is 5.5 inches, and the approximate borehole diameter is 8.75 inches.

Figure 6:
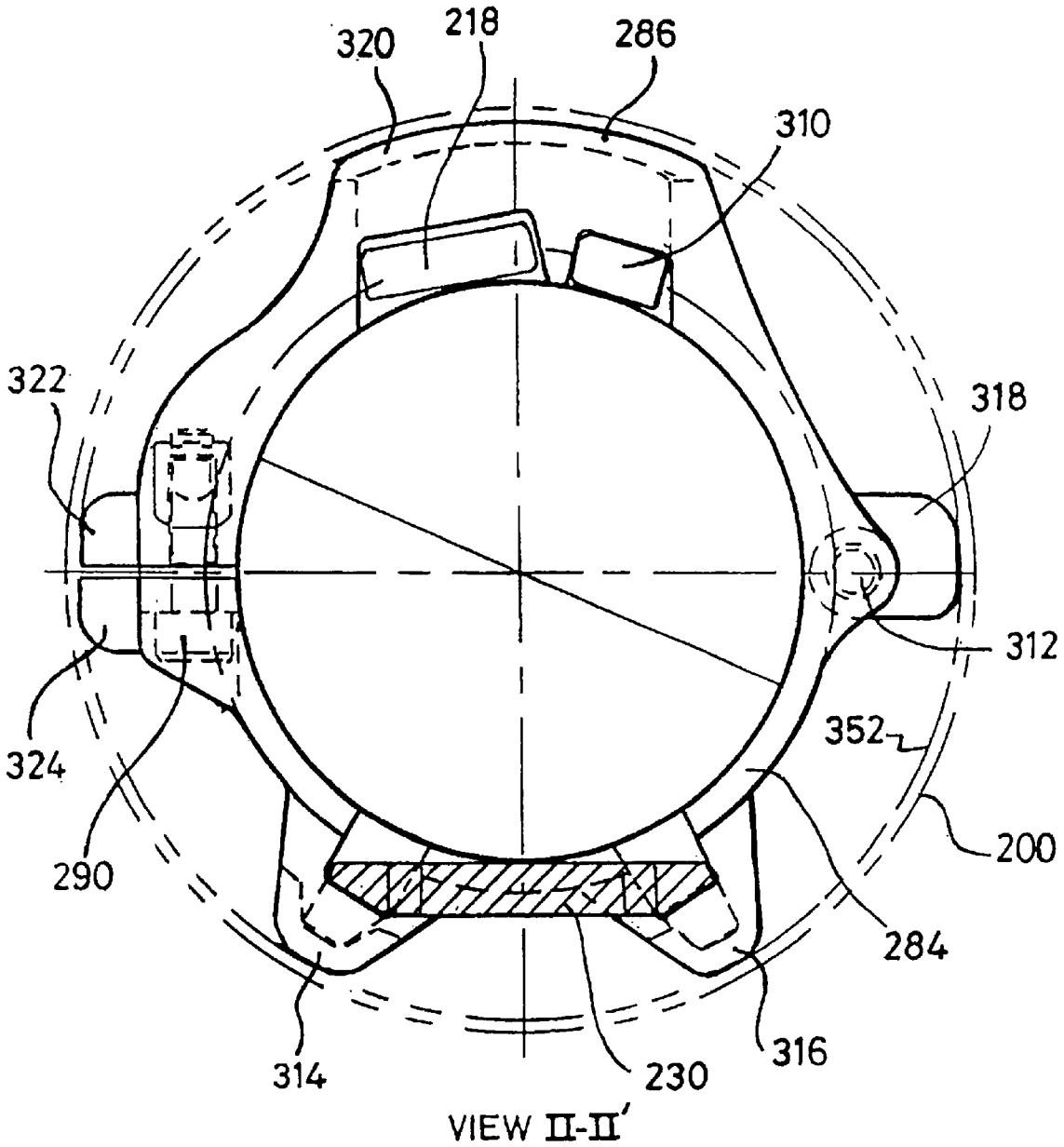
FIG. 6 shows a view of the clamp depicted in FIG. 4 in the direction of B–B', according to a preferred embodiment of the invention.

FIG. 6 shows a view of clamp 224 in the direction of B–B', according to a preferred embodiment of the invention. The portions of clamp 224 shown in FIG. 5 include lower body 284, upper body 286, screw and toggle 290, and hinge pin 312. Bar 230 is held in place by appropriately dimensioned notches in lower body 284. Note that bar 230 is flared to a wider dimension on the end being held by clamp 224. The wider dimension is preferred so that bar 230 can be held securely by clamp 224 by fitting into portion of flanges 314 and 316. Cable 218 is held by an appropriately dimensioned notch in upper body 286. Note that in this example, an additional cable 310 is provided and is held in place adjacent to cable 218. Similar to cable 218, cable 310 can be used for a variety of purposes, but in this preferred embodiment is use as part of a permanent sensor arrangement.

According to a preferred embodiment of the invention, clamp 224 also serves as a centralizer, by incorporating flanges 314, 316, 318, 320, 322, and 324 around the periphery. The flanges serve to both protect the cables and bar from the borehole wall (shown by the outer dotted line 200), and aid in centralizing the casing, cables and bar so as to avoid problems in cementing and to promote zonal isolation. As the cables are used in connection with a resistivity array, the bar, clamps, and casing are preferably coated with an insulating coating so as not to reduce the effectiveness of the array. In the example shown, the casing diameter is 5.5 inches, the approximate borehole diameter is 8.75 inches, and the design circle for the flanges is 8.5 inches in diameter (shown by the inner dotted circle 352).

Figure 7:
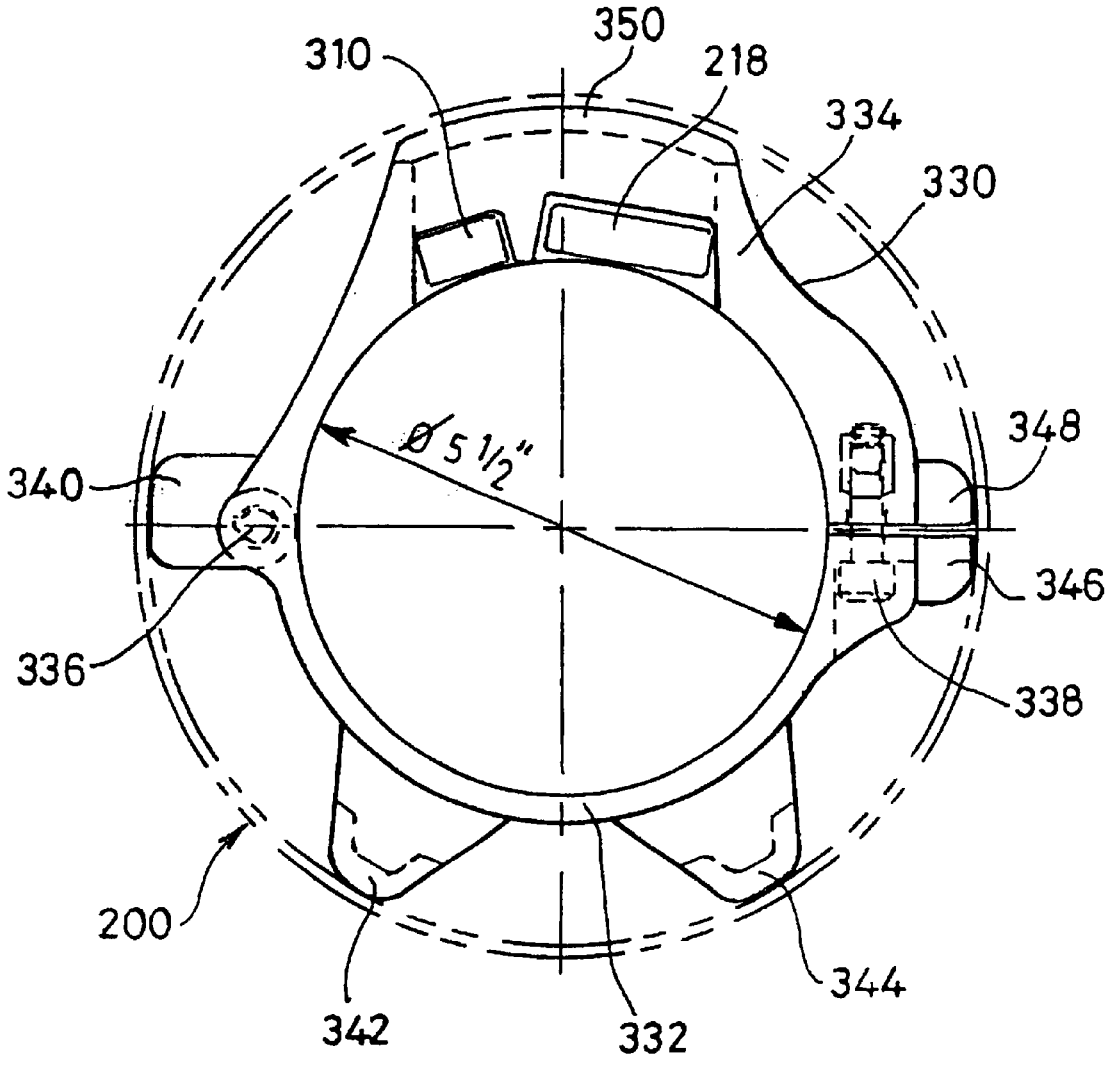
FIG. 7 shows a clamp used to hold the cable in position, according to a preferred embodiment of the invention.

Preferably, the cable is clamped to the outside of the casing at each casing collar, which are typically about 30 feet apart. FIG. 7 shows a clamp used to hold the cable in position, according to a preferred embodiment of the invention. Clamp 330 comprises a lower body 332, upper body 334, hinge pins 336, and screws and toggles 338. Note that cables 218 and 310 are held in place by appropriately dimensioned notches in upper body 334. Additionally, flanges 340, 342, 344, 346, 348, and 350 are provided as part of lower body 332 and upper body 334 in a fashion similar to the flanges described in connection with FIG. 6. Advantageously, the flanges serve to protect the cable from being damaged by the borehole wall by providing space and physical protection. The flanges also serve to centralize the casing and cables in the borehole so as to promote proper cementing and zonal isolation. Similarly to clamp 224, clamp 330 is appropriately dimensioned so as to fit over a section of casing collar. A plurality of clamps 330 are provided and spaced apart, each located at a casing collar so as to securely hold the cable to the casing. Additionally, the clamp depicted in FIG. 7 is preferably used for embodiments where the mass of material is integrated into the cable (such as the case where a very sensitive metallic detector or a gamma-ray detector is used).

In the described preferred embodiments, the clamps are tightened to the outside of the casing, and the cables and metallic bar are held at the predetermined offset angle by notches in the clamps. However, other means could be used to maintain the desired offset angle between the metal mass and cable. For example, the castleated interlocking pattern could be used to ensure the cable clamp is at a particular location with respect to a integral feature of the cable.

We claim:

1. A method of perforating a conduit in a hydrocarbon well so as to avoid perforating in a direction where a cable resides, the method comprising the steps of:

providing a mass of material at a predetermined offset angle as measured between a line from the axis of the conduit to the mass of material and a line from the axis of the conduit to the cable;

detecting the angular position of the mass of material with respect to the axis of the conduit using a detector adapted to sense the mass of material;

orienting a perforation device based on the angular position of the mass of material and the predetermined offset angle, such that the perforation device will create perforations in the conduit in a direction substantially away from the cable; and perforating the conduit so as to avoid substantial damage to the cable.

2. The method of claim 1 wherein the mass of material is primarily metallic, and the detector is adapted to sense metal.

3. The method of claim 2 wherein the detector is located inside the conduit during said step of detecting.

4. The method of claim 2 wherein the metallic material is a form of steel and the mass is located outside the conduit.

5. The method of claim 2 wherein the cable comprises a plurality of electrical conductors and is used to communicate with a plurality of sensors.

6. The method of claim 5 wherein the cable further comprises a fiber optic line.

7. The method of claim 5 wherein at least some of the sensors are located on the cable in the vicinity of the conduit to be perforated.

8. The method of claim 7 wherein the sensors are permanent sensors located along the cable that is clamped to the exterior surface of the conduit.

9. The method of claim 8 wherein the mass of metallic material is fixed to the exterior of the conduit using at least one clamping device.

10. The method of claim 1 wherein the conduit is a casing used in the hydrocarbon well.

11. The method of claim 1 wherein the cable comprises a plurality of electrical conductors and is used for telemetry.

12. The method of claim 1 wherein the predetermined offset angle is approximately 180 degrees.

13. The method of claim 1 wherein the predetermined offset angle is approximately 0 degrees.

14. The method of claim 1 wherein the axis of the hydrocarbon well in the area being perforated is substantially non-horizontal.

15. A method of perforating a conduit in a hydrocarbon well so as to avoid perforating in a direction where a sensor resides, the method comprising the steps of:

providing a mass of material at a predetermined offset angle as measured between a line from the axis of the conduit to the mass of material and a line from the axis of the conduit to the cable;

detecting the angular position of the mass of metallic material with respect to the axis of the conduit using a detector adapted to detect the mass of metallic material;

orienting a perforation device based on the angular position of the mass of metallic material and the predetermined offset angle, such that the perforation device will create perforations in the conduit in a direction substantially away from the sensor; and perforating the conduit so as to avoid substantial damage to the sensor.

16. The method of claim 15 wherein the sensor is a permanently installed sensor.

17. The method of claim 16 wherein the permanent sensor is attached to the exterior surface of the conduit.

18. The method of claim 17 wherein the mass of metallic material is fixed to the exterior of the conduit using at least one clamping device.

19. A system for perforating a conduit in a hydrocarbon well so as to avoid perforating in a direction where a cable resides, the system comprising:

a fixing device configured and adapted to fix a mass of material to an exterior portion of the conduit at a predetermined offset angle with respect to the cable, the predetermined offset angle measured in a plane substantially perpendicular to the axis of the conduit;

a detector adapted to detect the angular position of the mass of material with respect to the axis of the conduit using a detector adapted to sense the mass of material;

a perforating device adapted to perforate the conduit and surrounding structures; and an orientation device in mechanical communication with said perforation device, the orientation device adapted to orient the perforation device based on the angular position of the mass of material and the predetermined offset angle, such that the perforation device will create perforations in the conduit in a direction substantially away from the cable.

20. The system of claim 19 wherein the mass of material is metallic and the detector is placed inside the conduit when detecting the metallic material.

21. The system of claim 20 wherein the conduit is a casing used in the hydrocarbon well.

22. The system of claim 21 wherein the cable comprises a plurality of electrical conductors and is used to communicate with a plurality of sensors, and at least some of the sensors are located on the cable in the vicinity of the casing to be perforated.

23. The system of claim 22 wherein the sensors are permanent sensors located along the cable that is clamped to the exterior surface of the casing.

24. The system of claim 23 wherein the mass of metallic material is fixed to the exterior of the casing using at least one clamp.

25. The system of claim 24 wherein the predetermined offset angle is approximately 180 degrees.

* * * * *